United States Patent [19]

Frey et al.

[11] Patent Number: 5,058,801

[45] Date of Patent: Oct. 22, 1991

[54] COMPOSITE CAN

[75] Inventors: Robert E. Frey, Villa Hills, Ky.; John C. Whitaker, Cincinnati, Ohio

[73] Assignee: Cin-Made Corporation, Cincinnati, Ohio

[21] Appl. No.: 509,579

[22] Filed: Apr. 16, 1990

[51] Int. Cl.[5] ..... B65D 3/28

[52] U.S. Cl. ..... 229/3.5 MF; 220/601; 220/611; 220/613; 229/4.5

[58] Field of Search ..... 229/3.5 R, 3.5 MF, 4.5, 229/5.5; 220/601, 611, 613, 634

[56] References Cited

U.S. PATENT DOCUMENTS

| | | | |
|---|---|---|---|
| 2,982,457 | 5/1961 | D'Alelio | 229/3.5 MF |
| 3,355,348 | 11/1967 | Lamar | 229/3.5 MF |
| 3,434,644 | 3/1969 | Collie | 220/611 |
| 3,734,393 | 5/1973 | Stump | 229/5.5 |
| 3,972,467 | 8/1976 | Whittock et al. | 229/3.5 R |
| 3,998,354 | 12/1976 | Song . | |
| 4,010,875 | 3/1977 | Babiol . | |
| 4,011,961 | 3/1977 | Widen et al. . | |
| 4,059,201 | 12/1977 | Foster . | |
| 4,074,961 | 2/1978 | Reil . | |
| 4,185,747 | 1/1980 | Goncalves . | |
| 4,185765 | 1/1980 | McLaren . | |
| 4,261,503 | 4/1981 | Lawrence et al. . | |
| 4,262,819 | 4/1981 | Hayes | 229/5.5 |
| 4,270,677 | 6/1981 | Schmidt . | |
| 4,301,939 | 11/1981 | Pupp . | |
| 4,322,003 | 3/1982 | Long | 229/3.5 R |
| 4,337,104 | 6/1982 | Lynn . | |
| 4,344,545 | 8/1982 | Aschberger et al. . | |
| 4,356,926 | 11/1982 | Priestly et al. . | |
| 4,527,699 | 7/1985 | Namba et al. . | |
| 4,760,949 | 8/1988 | Elias | 229/4.5 |
| 4,848,601 | 7/1989 | Reil . | |
| 4,852,793 | 8/1989 | Homma et al. | 229/5.5 |
| 4,894,267 | 1/1990 | Bettle, III et al. | 229/3.5 R |

OTHER PUBLICATIONS

The Wiley Encyclopedia of Packaging Technology John Wiley & Sons, 1986, pp. 15 and 518.

*Primary Examiner*—Gary E. Elkins
*Attorney, Agent, or Firm*—Wood, Herron & Evan

[57] ABSTRACT

A composite container comprises lateral walls composed of laminar composite material sealed along at least one seam to produce a cylindrical or polyhedral body, a conical top member composed of plastic material joined to the lateral walls by adhesive means, and a bottom member of any suitable construction. Particular embodiments include containers for toxic chemical snad petroleum products.

6 Claims, 1 Drawing Sheet

COMPOSITE CAN

FIELD OF THE INVENTION

This invention pertains to containers composed of laminated composite sheet material. A particular aspect of this invention relates to composite containers suitable for storing toxic or hazardous chemicals.

BACKGROUND OF THE INVENTION

Containers or cans composed of composite sheet materials are well known in the prior art. Familiar examples include the paper composite one-quart can for motor oil and the paper walled containers used for storing foodstuffs such as Parmesan cheese. Typically such composite containers have substantially flat top and bottom end pieces usually composed of metal or plastic. The one quart motor oil can, for example, conventionally has a flat metal top and bottom which are crimped to the composite cylindrical lateral sidewalls. The Parmesan cheese can usually has a flat plastic two-piece top with perforations present on a portion of the inner piece and a rotatable cover piece which provides partial coverage of the inner piece. This flat plastic top commonly is glued to the composite sidewalls.

The laminated paper composite sheet material of which the lateral walls are composed offers several advantages. The material is economical and the paper portion is derived from a renewable resource. Paper is also a biodegradable material. Therefore many modern consumers perceive laminated paper containers to be desirable for environmental reasons.

Despite these advantages, the paper composite container has been displaced in recent years for some traditional applications. For example, many one quart motor oil containers are now made entirely of plastic. The plastic containers have conical tops which function as pouring spouts eliminating the need for a separate funnel. They also have screwtop closures which permit resealing the containers after partial use of the contents, unlike flat topped containers. These considerable advantages have led to the widespread adoption of the plastic motor oil can despite the cost and biodegradability disadvantages of plastic.

In light of the advantages of a reclosable conical spout and of a container composed of paper composite material, some containers have combined the two. For example, in U.S. Pat. No. 4,848,601, Reil discloses a container having lateral walls of coated cardboard joined together in a tubular configuration and having a plastic top with a pouring spout. This pouring spout is made of a flexible material so that it may be folded down within the walls of the container during storage, and is popped up by the consumer before use. The plastic top is secured to the sidewalls of the container by a method described only as "injection along the outer rim". In this context, "injection" apparently indicates a press fit, since no other sealing step or means is described or claimed. Namba et al., in U.S. Pat. No. 4,527,699, disclose a container having a trunk member of rectangular cross section composed of a laminated sheet material having a thermally bonding synthetic resin layer on the inner surface. This trunk member is joined along one seam by overlapping the thermal resin coated inner surfaces of the two edges and thermally welding the overlapped portion. This container also has a plastic top of pyramidal shape with a screw cap closure at its apex. A flange on this top fits into the tubular trunk member. The outer surface of this flange bears a thermoplastic resin layer as does the inner surface of the trunk member. The cap and trunk are thermally welded together to provide a tight seal.

These prior art containers do not suffice for all applications in which a conical top could be joined advantageously with a composite body. For example, joining the plastic top to the composite body by "injection" or a press fit does not provide a reliable seal. This is particularly troublesome when the contents are hazardous chemicals, since spills and leakage are unacceptable. Also, the thermal bonding technique employed by Namba et al. to join the plastic cap to the composite body requires that the composite material have an innermost layer of a thermoplastic, and therefore is not adaptable to composite material bearing a non-thermoplastic innermost layer. Moreover, thermal welding is advantageous principally in large scale automated production. Accordingly, one object of the present invention is to provide a container with a paper-based laminar composite body and a conical plastic top which are securely joined without thermal welding or injection of the top onto the body.

Particular challenges are presented by a container suitable for storing and dispensing toxic chemicals such as pesticides and herbicides or petroleum based products. Such a container must be strong and impermeable to minimize the chance of accidental spills or leakage. It must resist puncture and splitting. It must also provide a strong bond between the top and the lateral walls so that the top will not break out after rough treatment such as dropping. Moreover, it must be capable of being substantially completely emptied so that residual toxic materials do not inadvertently contaminate the empty container when it is discarded. A suitable container should minimize crevices in which powdered or granular toxic materials or viscous oils and solutions may lodge. In addition, controlled dispensing of the contents would be facilitated if means were provided for pouring the toxic chemical at a controlled or restricted rate. Accordingly, it is another object of this invention to provide a container with a paper-based laminar composite body and a conical plastic top which is suitable for storing and dispensing powdered or granular toxic chemicals.

SUMMARY OF THE INVENTION

In accordance with these objectives, the present invention provides a container having lateral walls formed of paper-based laminate composite sheet material, a plastic conical top having an orifice of diameter suitable for restricting the flow of pourable contents, a closure means for selectively opening and closing the said orifice, an adhesive means for joining the said plastic top to the said composite walls, and a bottom end of any suitable design. The composite sheet material of which the lateral walls of the body of the container body are made comprises at least two lamina joined together with an adhesive resin, at least one of the said lamina being made of paper or similar material. Preferably, the composite sheet material is overlapped and joined along a seam to form a circular-sectioned tubular body, although polyhedral lateral walls are acceptable. The plastic top tapers from maximal width at its base where it joins the lateral walls of the container body to a smaller width where it forms the exit spout. In a preferred embodiment, the tapered portion of the cap is substantially in the shape of an inverted truncated cone which intersects and merges with a cylindrical pouring spout. On its basal or body end, the top also bears a flange inwardly recessed from the outer edge of the cone. The said flange extends medially away from the spout and parallel to the lateral walls. The diameter of the flange is slightly smaller than the inner diameter of the lateral walls, thereby allowing it to fit within the said lateral walls of the container body with a slight clearance. In a preferred embodiment the flange is beveled to produce a slight gap between the bottom edge of the outer circumference of the flange and the composite lateral walls. This gap permits the flange to be inserted easily into the body of the container when a ring of adhesive coats the outer rim of the flange and/or the inner top lip of the lateral walls. This adhesive dries to fill the gap between the flange and the wall of the container.

DETAILED DESCRIPTION OF THE PREFERRED EMBODIMENT

Figure 1:
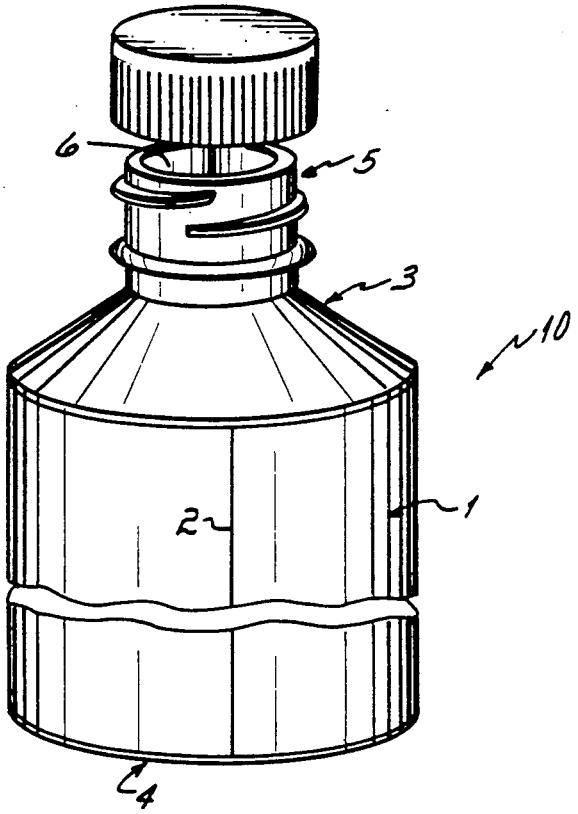
FIG. 1 is an exploded perspective of a preferred form of container in accordance with the invention.
Figure 2:
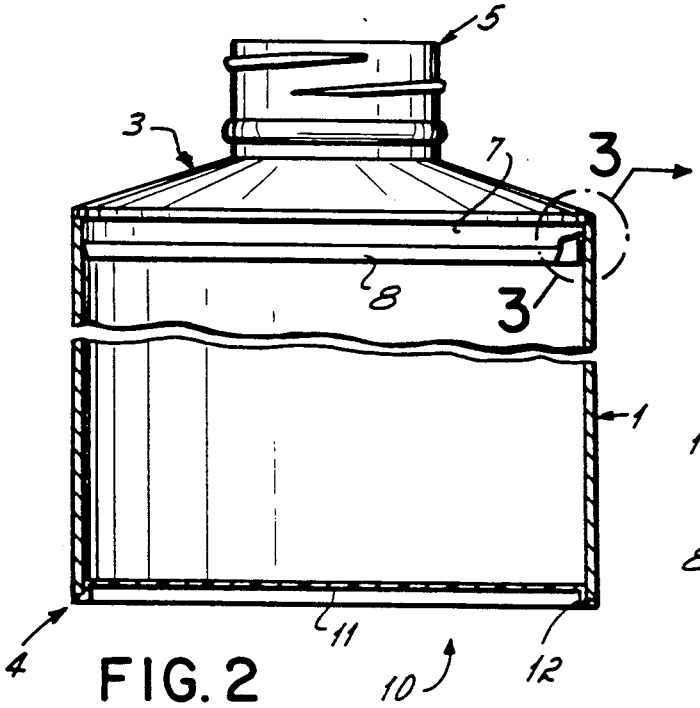
FIG. 2 is an axial section of the container of FIG. 1.

A composite container 10 especially adapted for storing hazardous chemicals and petroleum products, is shown in FIGS. 1 and 2. The composite material forming the lateral walls 1 of the container body is a laminar sheet preferably having at least one layer each of metal foil and of a chemically resistant thermoplastic such as polyethylene in addition to at least one layer of paper. The laminae are held together to form the composite sheet material by thin layers of adhesive resin between each of the laminae.

The composite sheet material may be formed into a tubular lateral wall by winding it into a cylinder and securing the overlapped edges with adhesive. Such winding may be spiral, which is preferred in applications where maximal strength is not required, because spiral winding is easier to produce. Familiar examples of spiral wound cylinders are the hollow cardboard cores around which paper towel and toilet paper rolls are wound. However, for maximal strength the wall preferably is convolutely wound. In a convolutely wound cylinder a rectangular length of the composite material is wound several times and secured with adhesive. This produces inner and outer overlap seams 2 running longitudinally down the cylinder. Alternatively the composite material may be folded to make polyhedral lateral walls which are overlapped at one edge (e.g., to form a square section) and secured with adhesive. Naturally, if a polyhedral lateral wall conformation is employed, the plastic top should be formed into a polyhedral pyramidal rather than conical shape.

The plastic top 3 and bottom 4 end pieces preferably are composed of a thermoplastic which is relatively chemically inert such as high density polyethylene or polypropylene. In contrast to the readily deformable plastic required by the Reil patent, which teaches that the top should fold down flat for storage and pop up when used, the plastic top of the present invention should be of sufficient thickness to confer mechanical stability. In a preferred embodiment, the container for toxic chemicals has a conical top made of high density polyethylene. The thickness of the polyethylene may range from a minimum of about 0.008 inch up to 0.25 inch or more.

The conical top 3 bears a substantially cylindrical pouring spout 5 which is preferably positioned in the center of the cap. The orifice 6 is sufficiently wide so that powdered or granular contents may be poured out readily, but is narrow enough to permit controlled dispensing of small amounts. In one favored embodiment, an orifice of about $1\frac{3}{8}$ inches diameter provides a good compromise between these competing considerations. However, orifices ranging from about 0.5 inches or less up to 4 inches or more are consistent with this invention, depending on the size of the container and the contents to be dispensed. The orifice shown in FIGS. 1 and 2 is provided with a screw top closure; however, other means of reversible closure such as a snap-on cap closure or a stopper are also consistent with this invention.

The flange portion 7 of the top extending parallel to and just within the lateral walls of the body of the container provides the surface to which the adhesive bonds to join the top to the said walls. In a preferred embodiment, flange 7 is beveled or tapered along its outer circumference to permit easier insertion into the tubular lateral walls 1. The bevel 8 may be present on only a portion of the axial length of the flange, as shown in FIG. 3.

Figure 4:
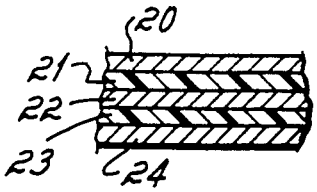
FIG. 4 is a cross sectional view of one type of laminated sidewall material, the "poly/foil" paper.
Figure 3:
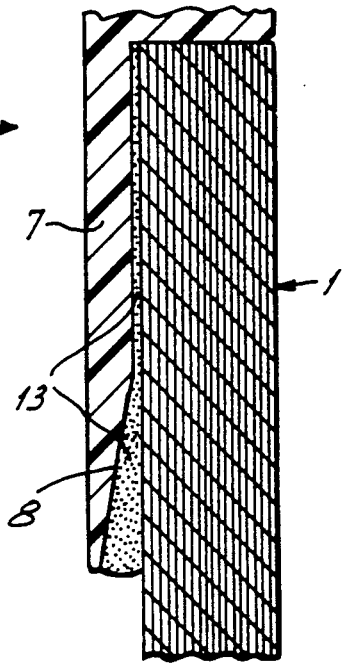
FIG. 3 is a detailed cross sectional view of the encircled area 3—3 of FIG. 2 showing the adhesive joint between the laminated sidewalls and the tapered flange.

The adhesive joint between the composite walls 1 and the flange 2 is shown in greater detail in FIG. 3. The thin layer of adhesive 13 between walls 1 and flange 2 is of greater thickness in the region of the bevel 8. The adhesive preferably fills all or a substantial portion of the gap to minimize the crevices in which the contents may be trapped. In an especially preferred embodiment, the laminated composite material is "poly/foil paper" shown in FIG. 4 which is composed of layers respectively of 33 pound kraft paper 20, 9 pound polyethylene 21, 0.0035 inch aluminum foil 22, 9 pound polyethylene 23, and 30 pound bleached paper 24. The relatively heavy paper layers confer mechanical strength while the polyethylene and foil layers are substantially impermeable to chemicals. Naturally, considerable variation in the make-up of this composite material is possible, consistent with the spirit of this invention.

In one preferred embodiment of a container for powdered or granular toxic chemicals such as insecticides or herbicides, the innermost layer is bleached paper.

In another embodiment preferred in some applications the innermost layer is foil coated with a thin plastic layer and sealed to a paper backing. This coated foil layer provides the inner lining in some applications, such as containers for motor oil, in which the innermost layer must be impervious to solvents and oils. The outer layers may be of any construction, such as layers of kraft paper.

Figure 5:
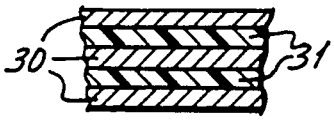
FIG. 5 is a cross sectional view of another type of laminated sidewall material in which no foil layer is present.

Another type of laminar material useful in some containers is shown in FIG. 5, in which three layers of paper 30 alternate with two layers of polyethylene 31. This laminated material has good moisture resistance and is more economical than poly/foil paper.

As will be apparent to one skilled in the art of composite container manufacture, a great many variations of laminated composite material construction are possible and may be employed in particular applications within the spirit and scope of this invention. The described materials are examples and are not intended to be exclusive.

The adhesive used to secure the top and/or bottom pieces to the walls 1 preferably should exhibit several characteristics: minimal tackiness after setting, so that the contents do not stick excessively to the bead of adhesive at the bottom of the flange; gap-filling ability, so that the space between the flange and sidewalls is filled and thus blocked by adhesive and cannot trap particles of the contents of the container; flexibility when dry, so that the adhesive does not separate or break away from the cap or sidewalls during rough handling; and strength at both high and low temperatures, so that the adhesive does not become ineffective during storage at winter or summer extremes to which it might be exposed.

A wide variety of adhesives are in common use for joining plastic or paper surfaces, including dextrin, resorcinol-modified starch, starch-formaldehyde, vegetable gums, protein-based glues, rubber solutions, phenol-formaldehyde resins, urea-formaldehyde resins, phenol-epoxy resins, acrylic and cyanoacrylic resins, polyvinyl alcohol resins, and polyvinyl acetate resin emulsions and solutions. Of these, polyvinyl acetate emulsions are widely used for joining paper to paper or wood. Vinyl acetate monomer is sometimes copolymerized with other monomers to make adhesives with altered functionality. Comonomers which are usefully employed with vinyl acetate include ethylene, maleate and fumarate diesters, acrylate esters, and vinyl laurate.

Several adhesives were tested in order to identify those with suitable properties for use in this invention. A ring of the adhesive to be tested was spread around the inner lip of a tubular "poly/foil" laminar composite body having a bleached paper innermost layer, and a high density polyethylene conical cap having a beveled flange was inserted. The assembled container was allowed to dry for 60 hours. Containers assembled with various adhesives were subjected to a "blow-off" test to assess the strength of the bond between the polyethylene cap and the tubular composite lateral walls. The tabulated values represent the air pressure in pounds per square inch (psi) required to blow the sealed conical top off of the tubular composite body. Tests were run at room temperature (approximately 70° F.). In order to evaluate the behavior of the adhesives under simulated summer and winter storage conditions in the field, some samples were held at 100° F. or 5° F. for two hours immediately prior to blow-off testing.

A second type of test was performed to evaluate the tackiness of the adhesives. A thin film of adhesive was spread over a $2\frac{7}{8}''$ diameter metal disk and allowed to dry for 24 hours. The disk surface was then covered with a granular diatomaceous earth powder ("Hi-Dri") similar in consistency to granular herbicides and insecticides. The granular material was poured off, and remaining adherent particles were counted.

The results of these tests are shown in Table I.

TABLE I

| Adhesive | Blow-Off Pressure, psi 100° F. | 70° F. | 5° F. | Tackiness (no. particles) |
|---|---|---|---|---|
| H. B. Fuller | | | | |
| V3844UN | 14.4 | 16.1 | 18.7 | 8 |
| CX3507UN | 4.4 | 13.9 | 7.1 | >>200 |
| N3495VB | 11.3 | 17.0 | 13.4 | 4 |
| National Starch | | | | |
| 33-1542 | 17.0 | 11.7 | 20.3 | 4 |
| 33-1556 | 16.3 | 20.2 | 17.9 | — |
| Beaver | | | | |
| 1-433 | — | 2.4 | — | — |

Fuller V3844UN and N3495VB and National 33-1542 and 33-1556 are all copolymers of vinyl acetate and ethylene. The V3844UN, N3495VB, and 33-1556 adhesives are water emulsions whereas the 33-1542 is dissolved in a chlorinated hydrocarbon solvent.

The data in Table I clearly show that Beaver 1-433 is appreciably weaker than the other adhesives, and it was eliminated from further consideration. Beaver 1-433 is a polyvinyl alcohol resin adhesive. Fuller CX 3507UN was strong at room temperature, but became much weaker at either high or low temperature extremes. Moreover, it was the most tacky of the tested adhesives. The remaining adhesives, Fuller V3844UN and N3495VB, and National 33-1542 and 33-1556, showed acceptable strength at all temperatures and low tackiness. Visual inspection of the seams between the top flange and the lateral walls of the container indicated that these adhesives also provide adequate gap filling ability.

All forms of these latter adhesives provided superior adhesion. Therefore a preferred embodiment of this invention utilizes an adhesive which is a copolymer of vinyl acetate and ethylene. The preferred copolymer adhesive may be applied to the inner lip of the lateral walls and the cap flange either in solution or as an emulsion. An especially preferred embodiment of this invention uses an adhesive selected from the group consisting of Fuller V3344UN, National 33-1452 and National 33-1556.

The bottom end piece 4 of the container may be constructed of any suitable material and joined to the lateral walls by any suitable means. In one preferred embodiment of a container for toxic chemicals, the bottom end piece is composed of high density polyethylene for chemical resistance and inertness. This end piece has a substantially flat bottom 11 and a peripheral flange 12 which fits snugly inside the lateral walls. The said flange is secured to the lateral walls with adhesive. The flange on the bottom end piece may extend from the flat bottom towards the center of the container, analogously to the flange on the conical top end piece. Alternatively, the flat bottom may fit entirely within the lateral walls, and the flange extends downwardly towards the lower lip of the lateral walls. This latter configuration is shown in FIGS. 1 and 2.

We claim:

1. A container comprising:

lateral walls composed of laminate composite sheet material, said composite sheet material having at least one lamina consisting essentially of paper, said composite sheet being joined along at least one seam to produce said lateral walls having a cylindrical or polyhedral configuration;

wherein the composite sheet material comprises "poly/foil paper", consisting essentially of lamina of 33 pound kraft paper, nine pound polyethylene film, 0.0035 inch metal foil, nine pound polyethylene film, 0.0035 inch metal foil, nine pound polyethylene film and 30 pound bleached paper;

a separately formed top member composed of thermoplastic material, said top member having a truncated conical or pyramidal shape tapering from a basal portion adjacent to the said lateral walls to an apical portion bearing a pouring spout with an orifice, said orifice having a closure means, said basal portion bearing a flange extending medially and parallel to the said lateral walls;

adhesive means for securing said top member to said lateral walls along the said flange; and a bottom member with means securing said bottom member to said lateral walls.

2. The container of claim 1 wherein the adhesive means for securing the said top member to said lateral walls comprises a resin copolymer of ethylene and vinyl acetate.

3. The container of claim 2 wherein the adhesive means is selected from the group consisting of H.B. Fuller V3844UN, H.B. Fuller N3495UB, National Starch 33-1542, and National Starch 33-1556 adhesives.

4. The container of claim 1 wherein the inner-most lamina of the composite sheet material is plastic-coated foil.

5. The container of claim 1 wherein the said top member is composed essentially of high density polyethylene thermoplastic.

6. The container of claim 1 wherein the said lateral walls have a cylindrical configuration and the said top member has a truncated conical shape.

* * * * *